US009573394B2

(12) United States Patent
Campanini

(10) Patent No.: US 9,573,394 B2
(45) Date of Patent: Feb. 21, 2017

(54) PRINTING MECHANISM

(71) Applicant: CUSTOM S.P.A., Fontevivo (Parma) (IT)

(72) Inventor: Alberto Campanini, Fidenza (IT)

(73) Assignee: CUSTOM S.P.A., Fontevivo (Parma) (IT)

( * ) Notice: Subject to any disclaimer, the term of this patent is extended or adjusted under 35 U.S.C. 154(b) by 0 days.

(21) Appl. No.: 14/917,819

(22) PCT Filed: Sep. 16, 2014

(86) PCT No.: PCT/IB2014/064561
§ 371 (c)(1),
(2) Date: Mar. 9, 2016

(87) PCT Pub. No.: WO2015/040545
PCT Pub. Date: Mar. 26, 2015

(65) Prior Publication Data

US 2016/0221367 A1 Aug. 4, 2016

(30) Foreign Application Priority Data

Sep. 18, 2013 (IT) ..... MO2013A0255

(51) Int. Cl.
*B41J 2/15* (2006.01)
*B41J 11/04* (2006.01)
(Continued)

(52) U.S. Cl.
CPC . *B41J 11/04* (2013.01); *B41J 2/32* (2013.01); *B41J 11/14* (2013.01); *B41J 23/025* (2013.01); *B41J 2202/31* (2013.01)

(58) Field of Classification Search
CPC ..... B41J 11/007; B41J 15/04; B41J 11/04; B41J 11/02; B41J 11/24
See application file for complete search history.

(56) References Cited

U.S. PATENT DOCUMENTS 7,568,778 B2 * 8/2009 Terada ..... B41J 13/0027 318/280
8,073,378 B2 * 12/2011 Calamita ..... G03G 15/75 347/116

(Continued)

FOREIGN PATENT DOCUMENTS

EP 0537679 A2 4/1993

OTHER PUBLICATIONS

International Search Report and Written Opinion of the International Searching Authority Application No. PCT/IB2014/064561 Completed: Feb. 11, 2015;Mailing Date: Feb. 27, 2015 8 pages.

*Primary Examiner* — Lamson Nguyen
(74) *Attorney, Agent, or Firm* — Whitmyer IP Group LLC

(57) ABSTRACT

A printing mechanism having an engaging body that is rotatable between an engaging position, in which it retains a printing roller in a position facing a thermal printing head, and a disengaging position wherein it enables the printing roller to be removed; a reversible drive shaft rotating in one direction rotates the printing roller and rotating in the opposite direction moves the engaging body to the disengaging position, owing to a unidirectional joint that connects the drive shaft to the engaging body only when the drive shaft rotates in an opposite direction.

10 Claims, 3 Drawing Sheets

(51) Int. Cl.

| | |
|---|---|
| ***B41J 11/14*** | (2006.01) |
| ***B41J 23/02*** | (2006.01) |
| ***B41J 2/32*** | (2006.01) |

(56) References Cited

U.S. PATENT DOCUMENTS

| | | | | |
|---|---|---|---|---|
| 8,482,586 | B1 * | 7/2013 | Martell | B41J 2/355<br>347/180 |
| 2008/0264277 | A1 | 10/2008 | Koizumi | |
| 2011/0142521 | A1 | 6/2011 | Miyashita | |

* cited by examiner

PRINTING MECHANISM

CROSS REFERENCE TO RELATED APPLICATIONS

This application is a national phase of PCT International Application No. PCT/IB2014/064561 filed Sep. 16, 2014. PCT/IB2014/064561 claims priority to IT Application No. MO2013A000255 filed Sep. 18, 2013. The entire contents of these applications are incorporated herein by reference.

BACKGROUND OF THE INVENTION

The invention relates to a printing mechanism, which is in particular insertable into a printing device for dispensing tickets, bills or receipts.

Specifically, but not exclusively, the invention can apply to a printing device that uses rolls of thermal paper.

In particular, the present invention refers to a printing mechanism made as a block that integrates a thermal printing head, a printing roller coupled with said printing head, a motor for rotating said printing roller and the transmitting arrangement for transmitting the motion of said drive shaft to said printing roller to drag the paper interposed between said roller and printing head, in which the integrated block forms a separate unit intended to be inserted into a printing device provided with the electronic control arrangement of the printing head and of the motor.

The prior art already comprises such a printing mechanism made as an integrated block and devoid, in general, of any electronic card that is suitable for controlling the printing head and/or the motor.

SUMMARY OF THE INVENTION

One object of the invention is to devise a printing mechanism having a printing roller that is easily removable.

One advantage is to enable the printing roller to be removed in a motorised and automatic manner.

One advantage is to incorporate into the printing mechanism the arrangement that is usable to enable the printing roller to be removed automatically.

One advantage is to provide a printing mechanism with a printing roller that is removable safely and reliably.

One advantage is to make a printing mechanism available that is constructionally simple and cheap.

Such objects and advantages and still others are achieved by the printing mechanism according to any one of the following claims.

In one embodiment, a printing mechanism comprises: an engaging body that is movable between an active engaging position—in which it retains a printing roller in position coupled with, and opposite, a thermal printing head—and an inactive disengaging position in which it leaves the printing roller free to permit the removal thereof; a reversible drive shaft that, by rotating in a first direction, rotates the printing roller and, by rotating in a second direction opposite the first, moves the engaging body to an inactive disengaged position; and a unidirectional joint arranged for detaching the drive shaft from the engaging body when the drive shaft rotates in the first direction, and for connecting the drive shaft to the engaging body when the drive shaft rotates in the second direction.

In one embodiment, the printing mechanism is a block that integrates the printing head, the printing roller, the motor, the motion transmitting arrangement and the engaging body, wherein the integrated block is devoid of electronic cards for controlling the printing head and/or the motor and forms a separate unit intended for coupling with a printing device provided with an electronic control arrangement.

BRIEF DESCRIPTION OF THE DRAWINGS

The invention can be better understood and implemented with reference to the attached drawings that illustrate an embodiment thereof by way of non-limiting example.

DETAILED DESCRIPTION

Figure 1:
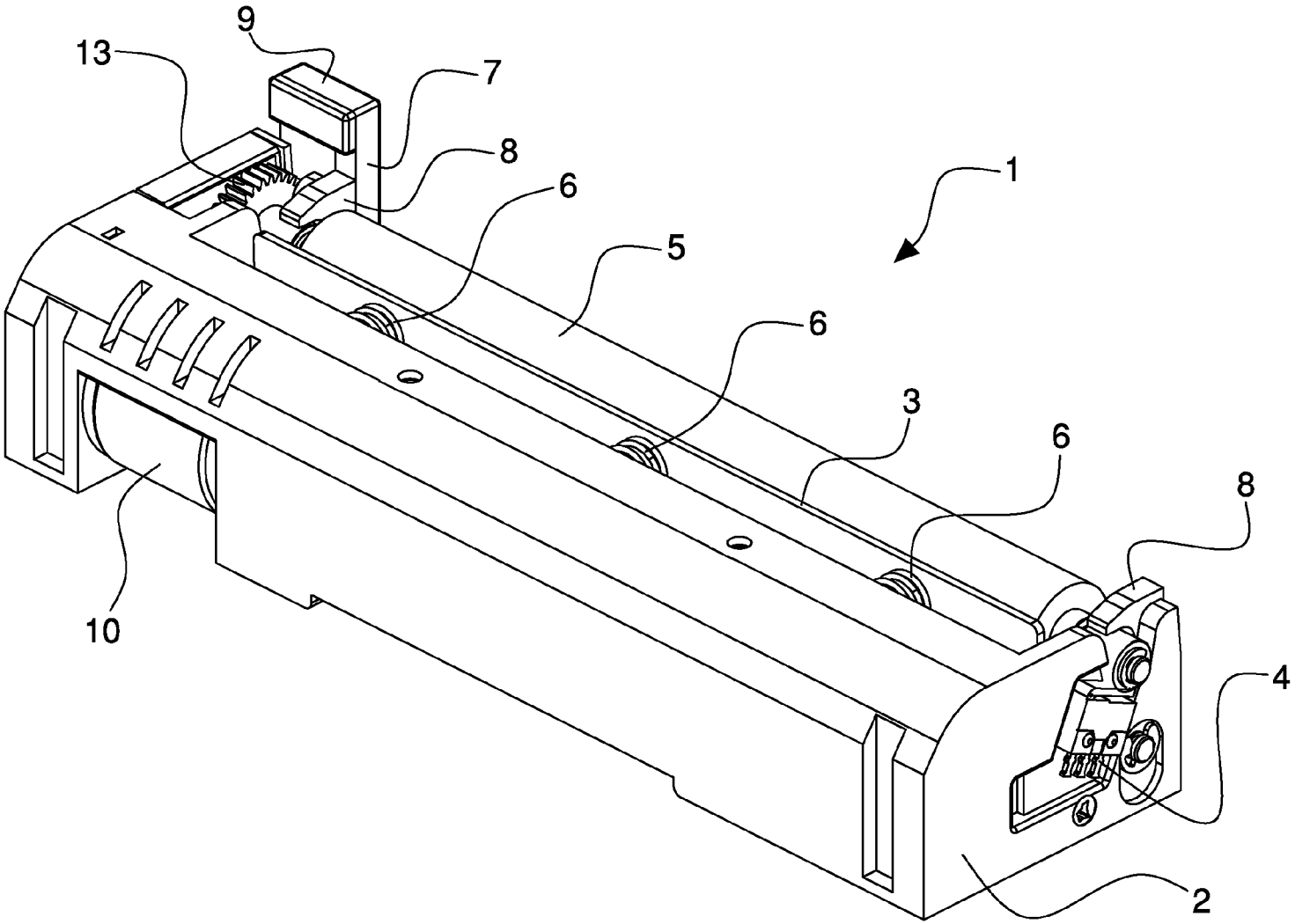
FIG. 1 is a perspective view of one embodiment according to the invention of a printing mechanism.

With reference to the above figures, overall with 1 a printing mechanism has been indicated that is usable, in particular, for being inserted into a printing device for dispensing tickets, bills or receipts. The printing mechanism 1 is made as a block that incorporates the various components of the mechanism, i.e. the elements that will be disclosed below. The integrated block will thus form a separate unit intended to be inserted into the printing device.

The printing mechanism 1 may be used, for example, to print on a roll of paper. The printing mechanism may also be used to print on other types of printing support. The printing support may be, for example (thermal) paper. In the ambit of this patent description, "paper" is defined as any type of print support that is suitable for printing with a (thermal) printing head.

The printing mechanism 1 comprises a frame 2 and at least one printing head 3 fitted on the frame 2. The frame 2 may comprise, for example, a box-shaped frame. The printing head 3 may be, in particular, a thermal printing head. The printing head 3 may be provided with an electric contact element 4 arranged on the frame 2 for connecting to at least one electronic control device (for example at least one control card) outside the printing mechanism 1.

The printing mechanism 1 comprises a printing roller 5 having an operating arrangement in which it is rotatably coupled (in a removable manner) with the frame 2. In this operating arrangement the printing roller 5 is coupled with and faces the printing head 3 to perform, in use, a paper printing and advancement step in which the paper advances interposed between the printing roller 5 and the printing head 3. An elastic element 6 may be provided, as in this specific case, to push the printing head 3 against the printing roller 5 with a preset force so as to carry out correct printing.

The frame 2 may be extended in length in a direction parallel to the axis of the printing roller 5. In particular, the length dimension of the frame 2 may be at least two or three times greater than the other two width and height dimensions. The length dimension may be, for example, less than 250 mm, or less than 200 mm, or less than 150 mm. The length dimensions may be, for example, greater than 50 mm, or greater than 75 mm, or greater than 100 mm.

Figure 2:
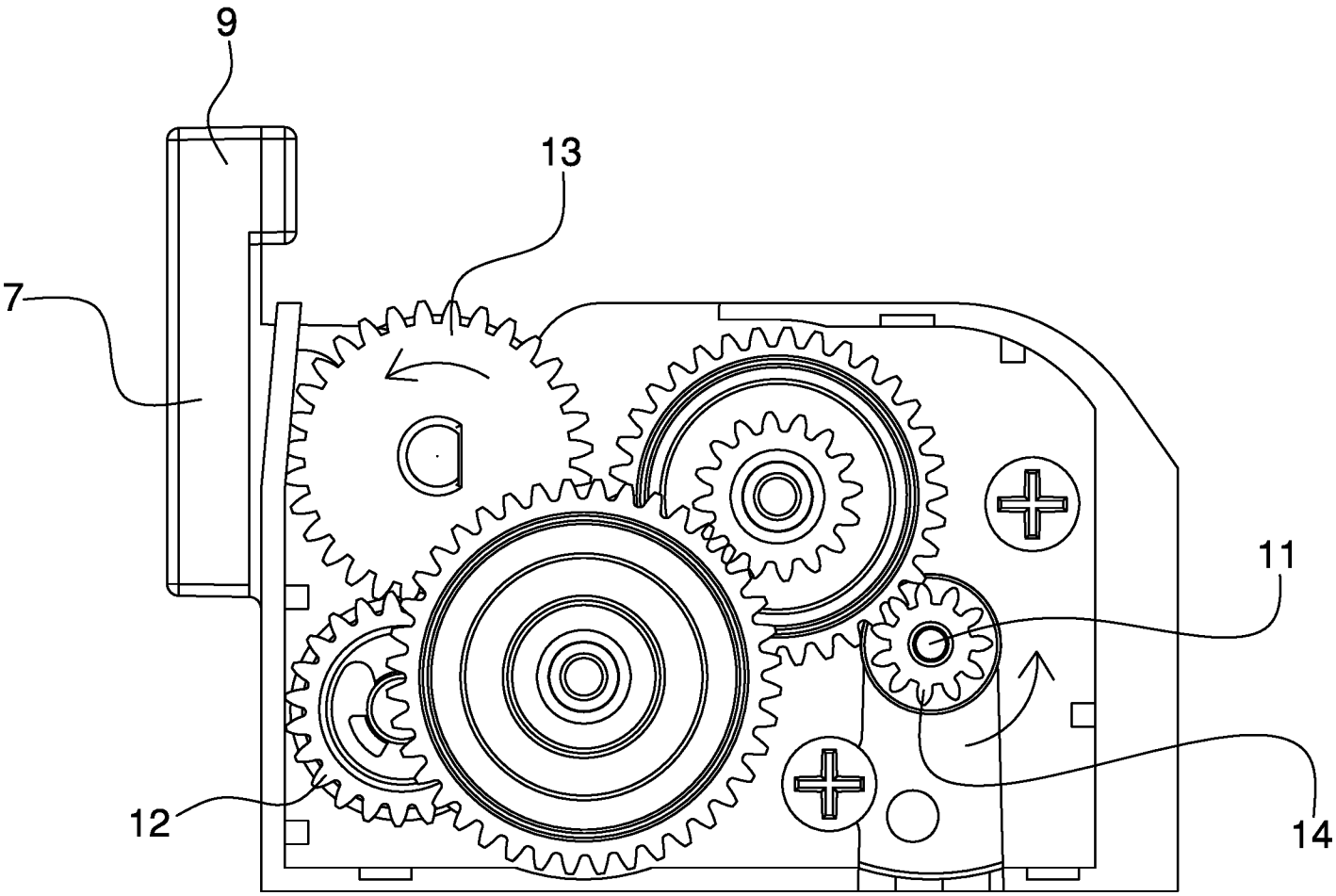
FIG. 2 is a vertical raised side view of the printing mechanism of FIG. 1 with the printing roller in the operating arrangement.
Figure 3:
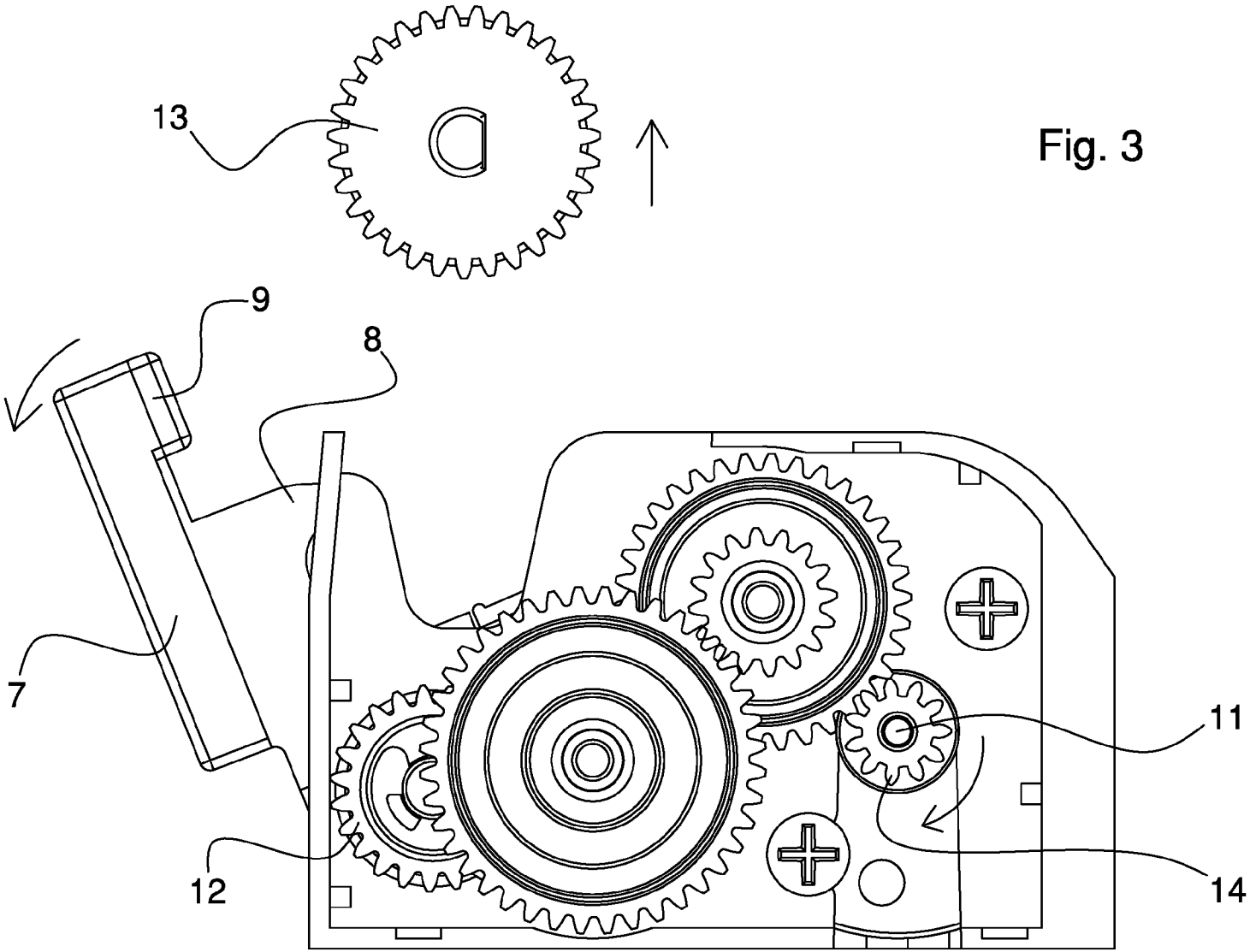
FIG. 3 is the view of FIG. 2 with the printing roller removed.

The printing mechanism 1 may be provided with an engaging arrangement (that may comprise, as in this example, a rotatable body 7) (rotatably) coupled on the frame 3 with the possibility of movement (rotation around a rotation axis) adopting at least one active position (FIG. 1 or FIG. 2) and at least one inactive position (FIG. 3). In the active position the engaging arrangement secures the printing roller 5 to the frame 2 to maintain the roller rotatable in the aforesaid operating arrangement. In the inactive position the engaging arrangement disengages the printing roller 5, leaving the printing roller 5 free to be removed from the frame 2.

The engaging arrangement may comprise, as in this example, at least one engaging arm 8 (carried integrally by the rotatable body 7) that, in the active position, closes in the upper part a seat for a pin of the printing roller 5 to retain the pin in the seat. The engaging arrangement may comprise, in particular, at least two engaging arms 8 (both carried integrally by the rotatable body 7) spaced apart from one another in the direction of the axis of the roller 5. The two engaging arms 8 may operate, as in the illustrated example, at two respective seats for two respective pins arranged at the two opposite ends of the axis of the printing roller 5.

The rotatable body 7 may be provided with a gripping zone 9 to facilitate the movement (rotation) of the rotatable body (for example to reclose the printing roller 5 in the operating arrangement manually). This gripping zone 9 may be arranged protruding above an engaging arm 8. This gripping zone 9 may protrude upwards in a removal direction of the printing roller 5. This gripping zone 9, in particular, will be distinct from the rotation axis of the rotatable body 7 to impose a rotation moment on the body by applying a force to the gripping zone 9. This gripping zone 9 may be arranged beyond the overall axial dimensions in length of an active cylindrical portion (intended for contact with the paper) of the printing roller 5, in particular the gripping zone 9 may be arranged opposite at least one part of the overall axial dimension of one of the two end pins of the printing roller 5.

The printing mechanism 1 comprises a motor 10 fixed to the frame 2 to rotate the printing roller 5 at least in one rotation direction. The motor 10 may have a drive shaft 11 with reversible rotation motion. The drive shaft 11 may thus rotate in a first rotation direction (FIG. 2, to rotate the printing roller 5 to advance the paper, in particular during the printing step) and in a second rotation direction (FIG. 3, to rotate the rotatable body 7 in order to disengage the printing roller 5) opposite the first. This motor 10 may comprise, for example, an electric motor. This motor 10 may comprise, for example, a step motor, or other type of motor.

The printing mechanism 1 may comprise a transmitting arrangement to transmit the motion of the drive shaft 11 (at least in the first rotation direction) to the printing roller 5 so as to drag the paper interposed between the roller and the printing head. The motion transmitting arrangement may comprise, in particular, a gear transmitting arrangement. The motion transmitting arrangement may comprise, for example, at least one first gear wheel 12 coaxial with the rotation axis of the engaging arrangement (rotatable body 7). The motion transmitting arrangement may comprise, as in this case, at least one second gear wheel 13 which is coaxial with the printing roller 5. This second gear wheel 13 may engage with the first gear wheel 12 when the printing roller 5 is in the operating arrangement facing the printing head 3. This second gear wheel 13 may be, in particular, integral with the printing roller 5, so that the second gear wheel 13 can be removed from the printing mechanism together with the roller (as visible in FIG. 3).

The transmitting arrangement may comprise, as in this example, a (gear) drive wheel 14 that is coaxial with the drive shaft 11 and coupled with the first gear wheel 12 via the aforesaid gear transmitting arrangement (for example with a reducing transmission ratio).

The printing mechanism 1 may comprise, as in this example, a unidirectional joint arrangement arranged for transmitting the motion of the drive shaft 11 (in the second rotation direction) to the aforesaid engaging arrangement (rotatable body 7) to move (rotate) the engaging arrangement from the active position to the inactive position so as to enable the printing roller 5 to be removed. Such unidirectional joint arrangement will be arranged, in particular, so that the motion of the drive shaft 11 in the first rotation direction is not transmitted to the engaging arrangement, so as not to disengage from the printing roller 5 in normal operation, i.e. when the drive shaft 11 rotates in the first rotation direction, maintaining the printing roller 5 in the operating arrangement.

Such unidirectional joint arrangement may comprise, as in this case, at least one unidirectional element that is arranged coaxially with the rotation axis of the engaging arrangement (rotatable body 7). The unidirectional joint arrangement may comprise, for example, a unidirectional bearing (not shown) which may be fitted, in particular, on the rotation axis of the engaging arrangement (rotatable body 7) which, in the specific case, coincides with the rotation axis of the first gear wheel 12.

The printing mechanism 1 could be provided, for example, with a sensor, in particular for detecting the presence of the paper or for detecting the presence of the printing roller 5 in the operating arrangement.

In particular, the printing mechanism 1 may be devoid of any electronic control card of the printing head 3 and/or of the motor 10. The (electronic and programmable) control arrangement of the printing head 3 and/or of the motor 10 (i.e. of the actuators associated with the printing mechanism) may be outside the printing mechanism and may be associated with the printing device into which the printing mechanism can be inserted. This printing device may comprise, in addition to the aforesaid control arrangement, a magazine for print support (rolls of paper), an outlet for the printed document and a path supplying the paper from the magazine to the outlet, in which this supplying path traverses a zone having a housing that is suitable for receiving the printing mechanism, so that the paper can pass between the printing head 3 and the printing roller 5 in the operating arrangement.

In use, when the motor 10 drives the drive shaft 11 in the first rotation direction (FIG. 2), the motion of the drive shaft 11 is transmitted to the printing roller 5 (located in the operating arrangement), for example to permit the advancement of the paper in the printing step; in this situation the motion of the drive shaft 11 is not transmitted to the engaging arrangement (rotatable body 7), which thus remains in the active position in which it retains the printing roller 5; in fact, the unidirectional joint arrangement (unidirectional bearing) is arranged in such a manner as to detach the first gear wheel 12 from the rotation axis of the engaging arrangement (rotatable body 7), so that the torque applied to the first gear wheel 12 is not transmitted to the engaging arrangement (being on the other hand transmitted to the second gear wheel 13).

On the other hand, if it is desired to expel the printing roller 5, the motor 10 is rotated in the second rotation direction (FIG. 3), so the motion of the drive shaft 11 is transmitted to the engaging arrangement (rotatable body 7), which is thus moved to the inactive disengaging position in which it leaves the printing roller 5 free (it is possible to set up on the frame 2 an elastic element arranged for pushing the printing roller 5 upwards to facilitate the expulsion thereof); in the event of driving the drive shaft 11 in the second rotation direction, to remove the printing roller 5, the unidirectional joint arrangement will connect the first gear wheel 12 to the rotation axis of the engaging arrangement (rotatable body 7), so as to transmit the torque from the first gear wheel 12 to the rotation axis of the engaging arrangement (rotatable body 7).

A printing mechanism is thus made that incorporates a simple and reliable mechanism to permit automatic removal of the printing roller 5.

The invention claimed is:

1. Printing mechanism comprising:

a frame;

a thermal printing head arranged on said frame;

a printing roller having an operating arrangement wherein it is rotatably coupled in a removable manner with said frame and faces said printing head to achieve in use a printing and advancement step wherein a printing support advances interposed between said roller and printing head;

an engaging arrangement rotatably coupled with said frame with the possibility of rotating around a rotation axis adopting at least one active position wherein it engages said printing roller with said frame in said operating arrangement and at least one inactive position wherein it leaves said printing roller free to be removed from said frame;

a motor arranged on said frame to rotate said printing roller at least in one rotation direction, said motor having a drive shaft with reversible rotation motion in a first rotation direction and in a second rotation direction opposite the first;

a transmission arrangement for transmitting the motion of said drive shaft at least in said first rotation direction to said printing roller to drag the printing support interposed between said roller and printing head;

a unidirectional joint arrangement arranged for transmitting the motion of said drive shaft in said second rotation direction to said engaging arrangement to rotate said engaging arrangement from said active position to said inactive position and enable said printing roller to be removed, and in order not to transmit the motion of said drive shaft in said first rotation direction to said engaging arrangement to maintain said printing roller in said operating arrangement.

2. Printing mechanism according to claim 1, wherein said unidirectional joint arrangement is coaxial with said rotation axis.

3. Printing mechanism according to claim 1, wherein said unidirectional joint arrangement comprises a unidirectional bearing.

4. Printing mechanism according to claim 1, wherein said engaging arrangement comprises a rotatable body bearing at least one engaging arm that, in said active position, closes in the upper part a seat for a pin of said printing roller to retain the pin in the seat.

5. Printing mechanism according to claim 4, wherein said rotatable body has at least two engaging arms operating in two seats for two pins at the two opposite ends of the axis of said printing roller.

6. Printing mechanism according to claim 4, wherein said rotatable body has a gripping zone for facilitating the rotation of said rotatable body, said gripping zone being arranged next to said transmission arrangement above said engaging arm and protruding upwards in a removal direction of said printing roller.

7. Printing mechanism according to claim 1, wherein said transmission arrangement comprises gears having at least a first gear wheel that is coaxial with said rotation axis.

8. Printing mechanism according to claim 7, wherein said transmission arrangement comprises at least a second gear wheel that is coaxial with said printing roller and engages with said first gear wheel when said printing roller is in said operating arrangement.

9. Printing mechanism according to claim 8, wherein said second gear wheel is integral with said printing roller so it is removed from the printing mechanism together with said printing roller.

10. Printing mechanism according to claim 1, made as a block that integrates said frame, said printing head, said printing roller, said engaging arrangement, said motor, said transmission arrangement and said unidirectional joint arrangement, said block forming a separate unit intended to be inserted into a printing device; said frame extending in length in a direction parallel to the axis of said printing roller, the dimension in length of said printing roller being at least two or three times greater than each of the other two dimensions in width and height, the length dimension being optionally comprised between 50 and 250 mm; said thermal printing head having an electric contact element arranged on said frame for connection with at least an electronic control device outside said printing mechanism.

* * * * *